US005965344A

United States Patent [19]

Ando et al.

[11] Patent Number: 5,965,344

[45] Date of Patent: Oct. 12, 1999

[54] SILVER HALIDE PHOTOGRAPHIC EMULSION

[75] Inventors: Hiroaki Ando; Haruhiko Masutomi, both of Hino, Japan

[73] Assignee: Konica Corporation, Tokyo, Japan

[21] Appl. No.: 09/020,828

[22] Filed: Feb. 9, 1998

[30] Foreign Application Priority Data

Feb. 13, 1997 [JP] Japan ..... 9-028936

[51] Int. Cl.[6] ..... G03C 1/035

[52] U.S. Cl. ..... 430/567

[58] Field of Search ..... 430/567

[56] References Cited

U.S. PATENT DOCUMENTS 5,492,801 2/1996 Maskasky ..... 430/567

5,512,427 4/1996 Maskasky ..... 430/567

5,728,515 3/1998 Irving et al. ..... 430/567

*Primary Examiner*—Mark F. Huff

*Attorney, Agent, or Firm*—Frishauf, Holtz, Goodman, Langer & Chick, P.C.

[57] ABSTRACT

A silver halide emulsion is disclosed, comprising tabular grains containing not less than 50 mol % bromide, having two parallel (111) major faces and an aspect ratio of 2 or more, and accounting for at least 50% of the total grain projected area; the tabular grains each comprising regions different in iodide concentrations, wherein one of the regions is a central region containing high iodide and a second of the regions is an annular band containing less iodide than the iodide concentration of the central region, and the annular band accounting for less than 5% of each major face.

4 Claims, 1 Drawing Sheet

SILVER HALIDE PHOTOGRAPHIC EMULSION

FIELD OF THE INVENTION

The present invention relates to a silver halide photographic emulsion for use in light sensitive photographic materials.

BACKGROUND OF THE INVENTION

Currently, silver halide light sensitive photographic materials are used for almost all high quality image recording in which high resolution capability is required. To enhance photographic sensitivity without deteriorating graininess, there have been employed silver halide tabular grains in silver halide photographic materials.

JP-A 3-121445 (herein, the term "JP-A" refers to an unexamined and published Japanese Patent Application) discloses tabular silver halide grains having an annular low iodide containing portion in the periphery of the grain, in which the sensitizing dye-adsorbing site and the chemical sensitizing site can be separated from each other so that improvements in the processes of light absorption, latent image formation and image development are realized. However, the disclosure does not describe definitely the amount of the annular low iodide portion stably formed on the major faces. JP-A 8-254778 discloses formation of an annular band in the major face of the tabular grain by the use of a crystal habit modifier, the band accounting for not less than 5% of the area of the major face and thereby the relationship between sensitivity and graininess being improved. However, the use of the crystal habit modifier, which often tends to deteriorate chemical sensitizing and spectral sensitizing capabilities, is not necessarily preferable.

SUMMARY OF THE INVENTION

It is an object of the present invention to provide a silver halide photographic emulsion improved in the relationship between sensitivity and graininess and a photographic material by the use thereof.

According to the inventors of the present invention, it was found that the use of tabular silver halide grains in which less than 5% of a (111) major face is accounted for by a low iodide portion, was effective for improving sensitivity-granularity relationship.

The object of the present invention can be accomplished by:

a silver halide photographic emulsion containing silver halide grains and a hydrophilic colloid, wherein at least 50% of the total grain projected area is accounted for by tabular silver halide grains containing not less than 50 mol % bromide and having two parallel (111) major faces and an aspect ratio of 2 or more, the tabular grains comprising regions different in iodide concentrations, wherein one of the regions is a central region containing high iodide and a second of the regions is an annular band containing less iodide than the iodide concentration of the central region, the annular band accounting for less than 5% of each major face.

DETAILED EXPLANATION OF THE INVENTION

Figure 1:
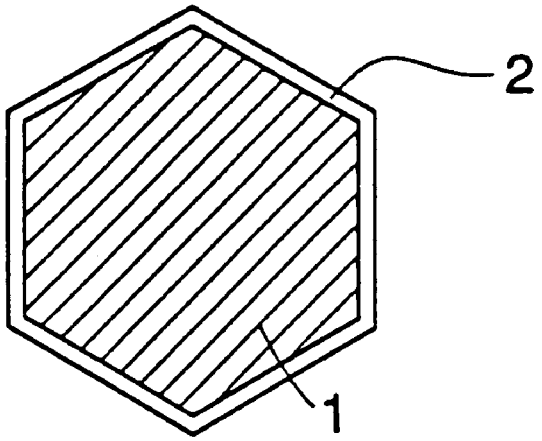
FIG. 1(*a*) is a schematic plane view of a tabular grain of Emulsion E according to the invention and FIG. 1(*b*), a sectional view thereof.
Figure 1:
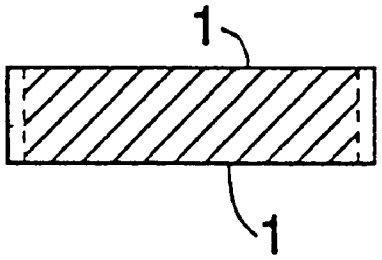

The annular, low iodide portion can be formed by growing tabular host grain at a low EAg, as described in JP-A 8-254778, wherein the concentration of the iodide to be added is less than the iodide contained in the tabular host grains. The grain growth can be achieved by adding fine silver bromide grains or fine silver halide grains containing less iodide than the major faces of the tabular host grains. The major faces according to the invention refers to two tabular face of the tabular grain, shown as 1 in FIGS. 1(*a*) and 1(*b*).

As a result of the inventor's research, it was proved that when the added silver halide exceeded a certain amount, a silver halide phase with a low iodide concentration, which 2 in the Figure, did not grow only in the annular band portion but abruptly deposited over all of the major faces. This finding was not disclosed nor suggested in the prior publication. In any event, it was proved to be preferable that the proportion of the annular band portion (2) to the major face (1) was small to stably form the annular band. According to the invention, the low iodide annular band portion preferably forms less than 5% of the major face. A portion of the major face with a low iodide concentration acts a chemical-sensitizing site, thereby enhancing the formation of latent images therein. On the other hand, a portion having a relatively high iodide concentration which is exposed on the major faces, promotes adsorption of a sensitizing dye to enhance sensitization efficiency as well as improves the adsorption of other useful photographic addenda, such as antifoggants and stabilizers. In the case when a low iodide portion precipitated on the major faces of the tabular host grains, separate presence of the dye adsorbing site and the chemical-sensitizing site becomes infeasible, resulting in grains with a shell having conventional core/shell structure.

The iodide concentration of the high iodide portion (i.e. the central region of the grain) is preferably not less than 3 mol %, more preferably, not less than 5 mol % and not more than 20 mol %, based on silver of the high iodide portion. The iodide concentration of the low iodide portion (i.e. the annular band portion), which may be optional as long as it is lower than that of the high iodide portion, is preferably not more than 7 mol % and more preferably not more than 5 mol %, including 0 mol %, based on silver of the low iodide portion.

The annular band leads to improved photographic performance characteristics, even if it is prepared in the presence of a crystal habit modifier. The crystal habit modifier, such as 4,5,6-triaminopyrimidine and iodo-8-hydroxyquinoline described in JP-A 8-454778 can be employed within the range in which chemical sensitization and spectral sensitization are not adversely affected.

The annular band according to the invention can be formed in the presence of excessive halide ions. Excessive salts can be removed by desalting. Examples of the desalting method include a noodle washing method, dialysis by the use of semipermeable membranes, a centrifugation method, a flocculation process, or an ion exchange method. After being desalted, the silver potential increases due to the decrease of the halide concentration, wherein the halide composition of the grain surface remains unaltered The silver potential can be adjusted with a halide solution. After the annular band having a low iodide concentration is formed, it is not preferable to add silver ions, such as a silver nitrate aqueous solution, for the purpose of adjustment of the silver potential. Thus, addition of silver ions in the presence of excessive halide results in formation of fine silver halide grains. The fine grains formed further precipitate, through Ostwald ripening, on the major faces having the annular band. As a result, distribution of the halide composition formed on the surface may be undesirably altered.

Precipitation of a low iodide portion on the major faces can be detected by measurement of the grain thickness by the AFM or the STM method, or adsorption of a sensitizing dye. Adsorption of the sensitizing dye onto silver halide grains is referred to T. H. James, "The Theory of the Photographic Process" 4th edition, published by Macmillan, page 236. Some sensitizing dyes are known to be adsorbed according to Langmuir isotherm. Reciprocal of the dye concentration of the supernatant solution when reaching half of the saturated adsorption amount, that is, the adsorption coefficient is employed as a measure of adsorption ability. As is known, the adsorption coefficient greatly depends upon the iodide composition of the grain surface. In cases where the iodide composition of the major faces do not substantially change before and after growth, the adsorption coefficient is little lowered. On the contrary, in cases where the major faces are changed to the low iodide composition, the adsorption coefficient is greatly lowered. Thus, it can be confirmed whether the low iodide annular band is formed or the low iodide is deposited on the major faces.

Alternatively, the change of the iodide composition on the major faces can be confirmed simply by the following method. The dye is added into a silver halide emulsion in an amount ranging from half of the saturated adsorption to the saturated adsorption, and after being allowed to stand under given conditions, the adsorption ability can be evaluated from the dye concentration in the supernatant solution. Thus, the less the amount of the dye remaining in the supernatant solution indicates that the iodide concentration of the grain surfaces increases, leading to enhanced adsorption ability of the grain surface. Contrarily, the more the amount of the dye in the supernatant indicates a less amount of the iodide on the surface. Lowering of the iodide composition on the major faces can be detected in such a manner as described above.

Formation of the annular band can be determined based on the measurement of the grain diameter and thickness, and in low temperature photoluminescence. JP-A 8-254778 describes determination of the low iodide band in low temperature photoluminescence.

In preferable chemical sensitization of the tabular grains of the invention, chemical sensitization nuclei are selectively formed in the low iodide band. In order to effectuate chemical sensitization, sensitizing dyes are previously adsorbed selectively onto the high iodide portion and then chemical sensitization is conducted. In this case, the progress of chemical sensitization is different from that of conventional chemical sensitization. In cases where the chemical sensitization site and the spectral sensitization site are not separately present, sensitizing dyes in the vicinity of the chemical sensitization site retard chemical sensitization. On the contrary, in cases where the chemical sensitization site and the spectral sensitization site are separated from each other, chemical sensitization is not retarded.

With regard to the tabular grains used in the invention, preparation methods and techniques for the use thereof are disclosed in U.S. Pat. Nos. 4,434,226, 4,414,310, 4,433,048, 4,439,520, 4,414,306, and 4,459,353; British Patent 2,112,157; JP-A 59-99433 and 62-209445. The shape of the tabular grains may be a triangle, hexagon or circle. Of these preferred is a regular hexagon having edges almost equivalent in length, as disclosed in U.S. Pat. No. 4,797,345. The tabular grains used in the invention may contain dislocation lines. The dislocation lines can be observed with transmission electron microscope. The tabular grains are preferably monodispersed and the structure of the monodispersed tabular grains and the preparation method thereof are described in JP-A 63-151618.

Sensitizing dyes used for spectral sensitization of the tabular grains are preferably those which are capable of being adsorbed selectively onto a high iodide portion of the grain. The sensitizing dyes may be cyanine dyes used in conventional color photographic materials. The sensitizing dye is preferably incorporated in an amount that can completely cover the high iodide portion.

As a protective colloid used in preparing a silver halide emulsion according to the invention, gelatin is advantageously employed. A variety of gelatins can be employed, examples thereof include lime-processed gelatin, acid-processed, and gelatin derivatives such as hydrolyzed gelatin and enzyme-treated gelatin. Hydrophilic colloids other than gelatin can be also employed; examples thereof include a graft polymer of gelatin and another polymer, proteins such as albumin and casein, cellulose derivatives such as hydroxyethyl cellulose, carboxymethyl cellulose and a cellulose sulfuric acid ester, saccharide derivatives such as starch derivatives, and synthetic hydrophilic polymers such as polyvinyl alcohol partial acetal, poly-N-vinyl pyrrolidone, polyacrylic acid, polymethacrylic acid, polyacrylamide, polyvinyl imidazole and polyvinyl pyrazole.

Chemical sensitization is applied to the surface of the grains used in the invention. Chemical sensitization is conducted at a pAg of 5 to 10, a pH of 5 to 8 and a temperature of 30 to 80° C. using an active gelatin described in T. H. James, "The Theory of the Photographic Process" fourth edition, Macmillan (1977), pages 67–76, and using a sulfur sensitizer, a gold sensitizer, a selenium sensitizer, a tellurium sensitized, a palladium sensitizer or a rhodium sensitizer, singly or in combination thereof, as described in Research Disclosure (hereinafter denoted as "RD") vol. 124 (1974) 1208; RD vol. 134 (1975) 13452; U.S. Pat. Nos. 2,642,361, 3,297,446, 3,772,031, 3,857,711, 3,901,714, 4,266,018 and 3,904,415; and British Patent 1,315,755.

A variety of antifoggants and stabilizers can be employed; examples thereof include azoles and azaindenes described RD 17643 (1978) pages 24–25, nitrogen-containing carboxylic acids or phosphoric acids described in JP-A 59-168442, mercapto compounds or their metal salts described in JP-A 59-111636, and acetylene compounds described in 62-87957. These additives are further detailed in RD 17643 (1978), RD 18716 (1979), and RD 307105 (1989). These compounds may replace a sensitizing dye adsorbed in the high iodide portion. The desorbed dye may be re-adsorbed onto the low iodide band portion, possibly resulting in non-separation of the dye-absorbing site and the chemical sensitization nucleus-forming site. However, these phenomena can be prevented by adjusting the ripening time after adding the antifoggant or stabilizer, or selecting the addition amount or the kind thereof.

Silver halide grains may be subjected to reduction sensitization.

Silver halide grains may contain a dopant overall within the grain, in the exterior or interior of the grain. The dopant may be incorporated in the form of an aqueous soluble salt, such as an ammonium, acetate, nitrate or sulfate of metals such as Ir, fe, Rh, Ru and Pb, or a hexa- or tetra-coordinated complex salt thereof. A ligands of the complex is selected from halo, aquo, cyano, cyanate, nitrocyl, thionitrocyl, oxo, or carbonyl. These metal compounds may be employed singly or in combination thereof.

In the invention, fine silver halide grains with a low iodide concentration are employed to form a low iodide band portion, wherein a photographically useful compound may be allowed to be adsorbed onto the fine grains. Examples of the photographically useful compounds include a chemical sensitizer, an antifoggant and a reduction sensitizer. The reduction sensitization nucleus may contain a dopant.

With regard to the silver halide emulsion of the invention, preparation thereof and photographic elements containing the emulsion are further referred to in RD 36544 (1994).

The silver halide emulsion of the invention is coated on a water-resistant support by any of the several conventional coating methods, such as dip-coating and slide-hopper coating. With regard to the water-resistant support, triacetate or polyester film base, baryta paper and polyethylene-coated paper are preferably employed.

EXAMPLES

The present invention will be further explained based on examples, but embodiments of the invention are not limited thereto.

Preparation of AgBrI (5 mol % I) Tabular Host Grains (Emulsion B)

To one liter of aqueous solution containing 4.5 g of KBr, 0.3 g of KI and 7 g of gelatin (pH 6.5, 30° C.) with stirring were added 27.5 ml of an aqueous silver nitrate solution (containing 32.9 g of silver nitrate, 0.7 g of gelatin and 0.14 ml of 1N nitric acid per 100 ml) and 27.5 ml of an aqueous halide solution (containing 23.2 g of KBr, 1.7 g of KI and 0.7 g of gelatin per 100 ml) at a flow rate of 25 ml/min. After 1 min., 545 ml of an aqueous solution containing 32 g of gelatin was added and the temperature was raised to 75° C. After ripening was further continued for 12 min., 21.4 ml of a 15% by weight silver nitrate aqueous solution was added for 3 min. Subsequently, a mixture of an aqueous 25% by weight ammonia solution (10 ml) and an aqueous 50% by weight ammonium nitrate solution (10 ml) was added and ripening was carried out for 30 min., then, the pH was adjusted to 6.5 by adding a 3N nitric acid aqueous solution and 16 ml of 10% by weight halide aqueous solution (KBr:KI=95:5 in mol) was added thereto. A 15% by weight silver nitrate aqueous solution and a halide aqueous solution (KBr:KI=95:5 in mol) were added by the double jet addition, while the silver potential was maintained at −20 mV, provided that the silver nitrate solution was added at a flow rate of 8 ml/min. for 10 min. and then at a flow rate of 15 ml/min. for 20 min. It was proved that 95% of the grain projected area of the resulting emulsion (denoted as Emulsion A) was accounted for by hexagonal tabular grains having (111) major faces. Based on transmission electron microscopic observation, it was further proved that the tabular grain had an average grain size (equivalent circular diameter, ECD) of 1.10 μm, an average grain thickness of 0.22 μm and a coefficient of variation of grain size of 10.5%.

Preparation of Silver Bromide Fine Grain Emulsion (Emulsion D)

An aqueous gelatin solution of 1200 ml (containing 48 g of gelatin and 0.2 g of KBr) was added to a reaction vessel at 40° C. and further thereto were added an aqueous silver nitrate solution (containing 16.9 g of silver nitrate, 0.9 g of gelatin and 0.3 ml of 1N nitric acid per 100 ml) and a aqueous halide solution (containing 11.23 g of KBr and 0.9 g of gelatin per 100 ml) at a flow rate of 30 ml/min. for 10 min. and then at a flow rate of 50 ml/min. for 7 min. Stirring further continued for 2 min. to obtain Emulsion D with an average grain diameter (equivalent circular diameter) of 0.05 μm.

Preparation of Inventive Tabular Grains Having a Low-Iodide Annular Band (Emulsion E)

To Emulsion B was added a fine silver bromide grain emulsion (Emulsion D) in an amount of 0.05 mol based on silver per 1 mol based on silver of Emulsion B, at a temperature of 60° C. and a silver potential of −25 mV, and ripened for 30 min. to obtain Emulsion E.

Preparation of Comparative Tabular Grain Emulsion (Emulsion F)

To Emulsion B was added a fine silver bromide grain emulsion (Emulsion D) in an amount of 0.08 mol based on silver per 1 mol based on silver of Emulsion B, at a temperature of 60° C. and a silver potential of −25 mV, and ripened for 30 min. to obtain Emulsion F.

To each of Emulsions B, E and F was added a sensitizing dye (S-1) in an amount corresponding to 90% of saturated absorption. Each emulsion was allowed to stand at 60° C. and a silver potential of −25 mV for 10 min. and the dye concentration of the supernatant was measured. The concentration was shown as a relative value, based on the concentration of Emulsion B being 1.0 Results are shown below.

Sensitizing dye (S-1)

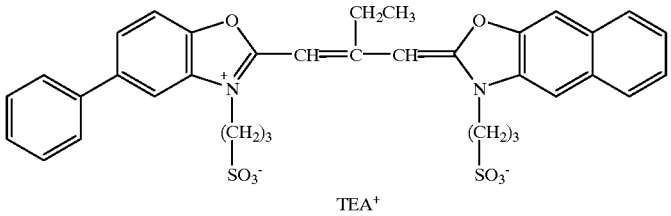

| Emulsion | Concentration |
|---|---|
| B | 1.0 |
| E | 1.05 |
| F | 2.5 |

As can be seen from the results, the dye concentration of the supernatant of emulsion F was markedly higher, indicating that the iodide concentration of the major faces was lowered.

The average ECD of Emulsion E was increased from 1.10 μm to 1.12 μm without variation in thickness. Further, the tabular grain was sliced in the direction of the grain thickness using a microtome and the iodide distribution of the intercept was measured by analytical Electron microscopy. As a result, the tabular grains each were comprised of two silver halide phases different in the iodide concentration. One was a central region (5 mol % I) and another was an annular band portion (0 mol % I), and the annular band portion accounted for 4% of the major face.

The average ECD of Emulsion f was increased from 1.10 μm to 1.13 μm with a little increase in thickness. The tabular grains each were comprised of two silver halide phases different in the iodide concentration. One was a central region (4.9 mol % I) and another was an annular band portion (0 mol % I), and the annular band portion accounted for 6% of the major face. It was further shown that the central portion was covered with a thin layer of AgBr.

Each of emulsions B, E and F was spectrally sensitized with the sensitizing dye (S-1) and then chemically sensitized at 60° C. with potassium thiocyanate, sodium thiosulfate and potassium chloroaurate. After completing chemical sensitization, 4-hydroxy-6-methyl-1,3,3a,7-tetraazaindene and 1-phenyl-5-mercaptotetrazole was added to the emulsion. Further thereto were added couplers 1 and 2, surfactant and gelatin. Each of the resulting emulsions was coated on a cellulose acetate film base coated with a anti-halation layer and a protective layer containing a surfactant a hardener [bis-(vinylsulfonyl)methane] was further coated on the emulsion layer to obtain a photographic material sample.

Coupler 1

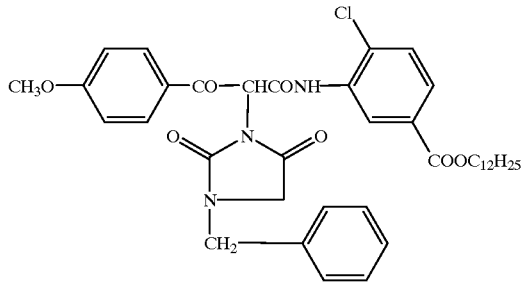

Coupler 2

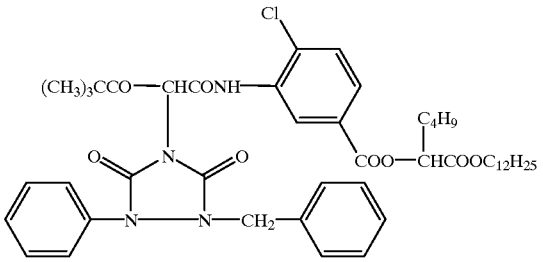

The thus prepared photographic material samples were each expose, through a yellow filter, for 0.01 sec. and processed according the following processing steps. Processed samples were each subjected to sensitometry using a densitometer (PDA-65, produced by Konica).

| Processing step | Time | Temperature |
|---|---|---|
| Color developing | 3 min. 15 sec. | 38 ± 0.3° C. |
| Bleaching | 45 sec. | 38 ± 2.0° C. |
| Fixing | 1 min. 30 sec. | 38 ± 2.0° C. |
| Stabilizing | 1 min. | 38 ± 5.0° C. |
| Drying | 1 min. | 55 ± 5.0° C. |

The following color developing solution, bleaching solution, fixing solution and stabilizing solution were employed.

Color Developing Solution

| | |
|---|---|
| Water | 800 ml |
| Potassium carbonate | 30 g |
| Potassium hydrogen carbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-Amino-3-methyl-N-ethyl-N-(β-hydroxyethyl)aniline sulfate | 4.5 g |
| Diethylenetriaminepentaacetic acid | 3.0 g |
| Potassium hydroxide | 1.2 g |

Water was further added to make 1 liter and the pH was adjusted to 10.0 with potassium hydroxide or 29% sulfuric acid.

Bleaching Solution

| | |
|---|---|
| Water | 700 ml |
| Ammonium ferric 1,3-diaminopropane-tetraacetate | 125 g |
| Ethylenediaminetetraacetic acid | 2 g |
| Sodium nitrate | 40 g |
| Ammonium bromide | 150 g |
| Glacial acetic acid | 40 g |

Water was further added to make 1 liter and the pH was adjusted to 4.4 with ammonia water or glacial acetic acid.

Fixing Solution

| | |
|---|---|
| Water | 800 ml |
| Ammonium thiocyanate | 120 g |
| Ammonium thiosulfate | 150 g |
| Sodium sulfite | 15 g |
| Ethylenediaminetetraacetic acid | 2 g |

Water was further added to make 1 liter and the pH was adjusted to 6.2 with ammonia water or glacial acetic acid.

Stabilizing Solution

| | |
|---|---|
| Water | 900 ml |
| 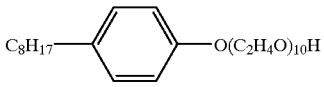 | 2.0 g |
| Dimethylol urea | 0.5 g |
| Hexamethylenetetramine | 0.2 g |
| 1,2-benzisothiazoline-3-one | 0.1 g |
| Siloxane (L-77, produced by UCC) | 0.1 g |
| Ammonia water | 0.5 ml |

Water was further added to make 1 liter and the pH was adjusted to 8.2 with ammonia water or 50% sulfuric acid.

Granularity readings of each processed sample was made according to the method described in SPSE Handbook of Photographic Science and Engineering, Edited W. Thomas, pages 934–939. Glanurarity readings at each step were divided by the contrast at the same step and the minimum contrast normalized granularity reading was recorded. Contrast-normalized granularities were chosen for comparison to eliminate granularitydifferences attributable to contrast differences. Further, since relationship between variation of sensitivity and that of granularity at a fixed silver coating amount and light efficiency is recognized (see, e.g. JP-A 8-101472 on page 22), the granularity was converted to that of emulsion B and sensitivity was corrected in terms of granularity. Sensitivity of each sample was shown as a relative value, based on the sensitivity of Sample 1 being 100, as below.

| Sample | Emulsion | Sensitivity | Remark |
|---|---|---|---|
| 1 | B | 100 | Comp. |
| 2 | E | 110 | Inv. |
| 3 | F | 98 | Comp. |

As can be seen from the results, the present invention led to improved sensitivity-granularity relationship.

What is claimed is:

1. A silver halide photographic emulsion containing silver halide grains and a hydrophilic colloid, wherein at least 50% of the total grain projected area is accounted for by tabular silver halide grains containing not less than 50 mol % bromide and having two parallel (111) major faces and an aspect ratio of 2 or more, the tabular grains comprising regions different in iodide concentrations, wherein one of the regions is a central region containing high iodide and a second of the regions is an annular band containing less iodide than the iodide concentration of the central region, and the annular band accounting for less than 5% of each major face.

2. The silver halide emulsion of claim 1, wherein said annular band contains not more than 5 mol % iodide.

3. The silver halide emulsion of claim 1, wherein said central region contains 5 to 20 mol % iodide.

4. The silver halide emulsion of claim 1, wherein said annular band contains not more than 5 mol % iodide and said central region contains 5 to 20 mol % iodide.

* * * * *